US005452850A

United States Patent [19]

Allsop

[11] Patent Number: 5,452,850

[45] Date of Patent: Sep. 26, 1995

[54] RECLOSABLE DISPENSING CARTON

[75] Inventor: Frederick M. Allsop, Lansdale, Pa.

[73] Assignee: Jefferson Smurfit Corporation, Clayton, Mo.

[21] Appl. No.: 333,030

[22] Filed: Nov. 1, 1994

[51] Int. Cl.[6] ..... B65D 5/70

[52] U.S. Cl. ..... 229/219; 222/541.9; 222/541.5; 229/229

[58] Field of Search ..... 229/215, 217, 229/219, 229, 232, 240; 222/541, 565

[56] References Cited

U.S. PATENT DOCUMENTS

| | | | |
|---|---|---|---|
| 1,303,138 | 5/1919 | Woolwine | 229/229 |
| 2,002,485 | 5/1935 | Alfred | 229/217 |
| 2,236,527 | 8/1943 | Emmerich | 229/229 |
| 2,360,415 | 10/1944 | Gilbert | 229/229 |
| 4,168,003 | 9/1979 | Wysocki | 229/217 |
| 4,706,875 | 11/1987 | Blackman | 229/229 |
| 4,799,594 | 1/1989 | Blackman | 229/229 |
| 5,044,503 | 9/1991 | Wein | 229/215 |
| 5,145,111 | 9/1992 | Giblin | 229/219 |
| 5,205,480 | 4/1993 | Roccaforte | 229/229 |

FOREIGN PATENT DOCUMENTS

| | | | |
|---|---|---|---|
| 59251 | 5/1954 | France | 229/240 |
| 1353079 | 5/1974 | United Kingdom | 229/232 |

*Primary Examiner*—Gary E. Elkins
*Attorney, Agent, or Firm*—Richard W. Carpenter

[57] ABSTRACT

A shaker type reclosable dispensing carton which includes an intermediate top closure flap having poring holes located in a depressible portion of the flap which can be depressed into the plane of an underlying flap, when the carton is reclosed, to allow a hinged outer closure flap pull-up portion to be depressed into the plane of the intermediate flap to effect a friction type locking closure between the intermediate and outer closure flaps.

6 Claims, 1 Drawing Sheet

RECLOSABLE DISPENSING CARTON

BACKGROUND OF THE INVENTION

1. Field of the Invention

This invention relates to reclosable dispensing cartons, and more particularly to a shaker type dispensing carton with pouring holes in a top wall intermediate closure flap and a outer closure flap pull-up portion for covering the holes upon carton closure.

2. Description of the Background Art

A background art search directed to the subject matter of this invention conducted in the United States Patent and Trademark Office disclosed the following U.S. Pat. Nos.:

| | | | |
|---|---|---|---|
| 2,020,680 | 2,470,388 | 2,593,019 | 2,983,422 |
| 3,395,848 | 3,438,565 | 3,971,506 | 4,015,768 |
| 4,019,673 | 4,113,103 | 4,308,956 | RE 31,425 |
| 4,706,875 | 5,007,542 | 5,044,503 | 5,205,480 |

None of the patents uncovered in the search discloses a shaker type reclosable dispensing carton which includes an intermediate top closure flap having poring holes located in a depressible portion of the flap which can be depressed into the plane of underlying flaps, when the carton is reclosed, to allow a hinged outer closure flap pull-up portion to be depressed into the plane of the intermediate flap to effect a friction type locking closure.

SUMMARY OF THE INVENTION

It is a primary object of the invention to provide an improved, shaker type, reclosable dispensing carton with an improved friction type reclosure feature.

A more specific object of the invention is the provision of a top wall closure arrangement for a one-piece paperboard carton which includes an intermediate closure flap with poring openings located in a depressible portion of the flap, which portion can be depressed into the plane of underlying intermediate flaps, when the carton is reclosed, to allow a hinged outer closure flap pull-up portion to be depressed into the plane of the intermediate flap to afford a friction type locking reclosure.

These and other objects of the invention will be apparent from an examination of the following description and drawings.

It will be understood that, for purposes of clarity, certain elements may have been omitted from certain views where they are believed to be illustrated to better advantage in other views.

DESCRIPTION OF THE PREFERRED EMBODIMENT

Figure 1:
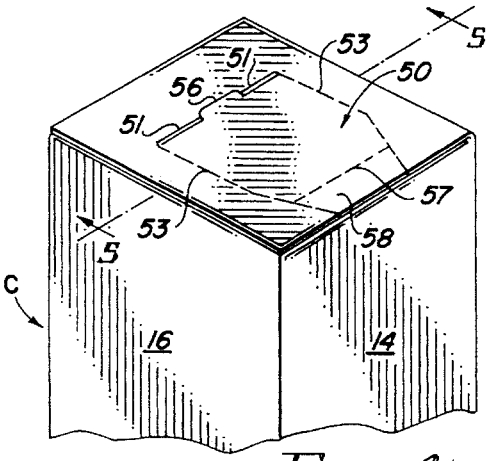
FIG. 1 is a partial isometric view of a reclosable dispensing carton embodying features of the present invention, shown before initial opening of the carton.
Figure 2:
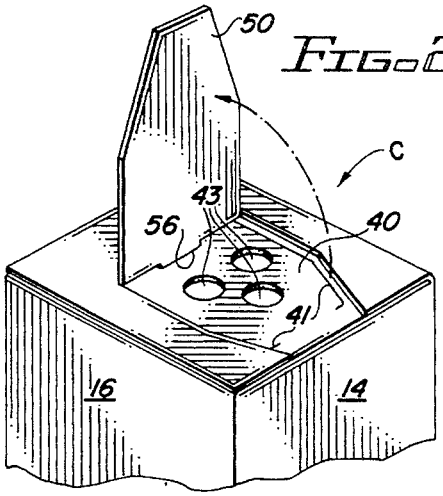
FIG. 2 is a view similar to that of FIG. 1, but with the carton shown in an open position ready for dispensing a product.
Figure 3:
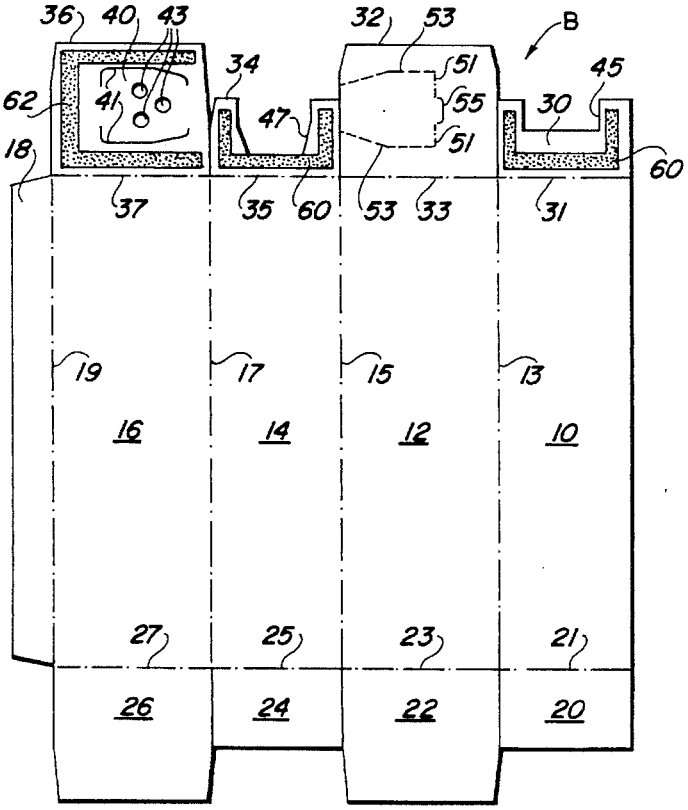
FIG. 3 is a plan view of a blank of foldable sheet material from which the carton illustrated in the other views may be formed.
Figure 4:
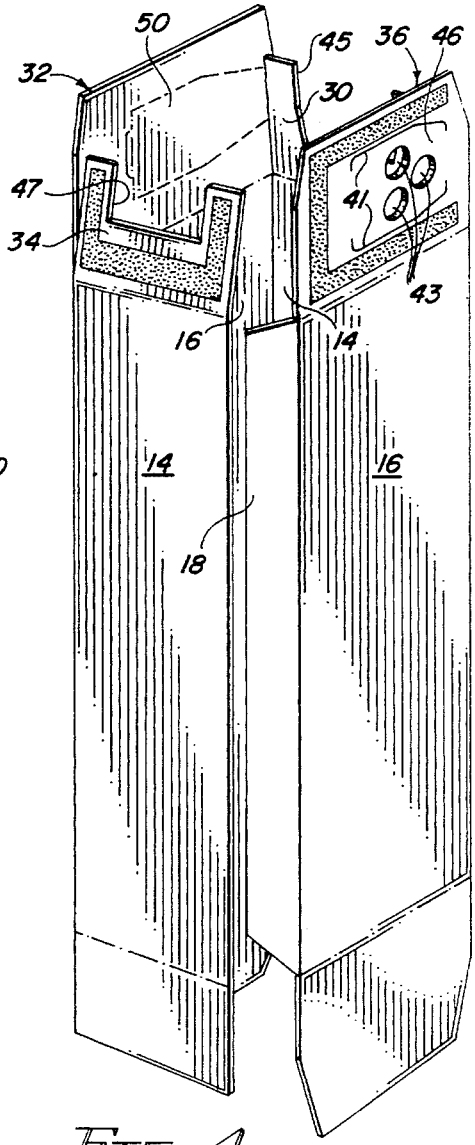
FIG. 4 is a partial isometric view showing one step in the erection of the carton from the blank.

Referring now to the drawings for a better understanding of the invention, It will be seen that a carton embodying features of the invention, and indicated generally at C in FIGS. 1 and 2, may be formed from a unitary blank of foldable sheet material, such paperboard, indicated generally at B in FIG. 3 of the drawings.

As best seen in FIG. 3, carton C includes a tubular body comprising a first minor side wall panel 10, a first major side wall panel 12, a second minor side wall panel 14, a second major side wall panel 16, and a glue panel 18, which have adjacent side edges foldably joined to each other along parallel fold lines 13, 15, 17, and 19, respectively.

The lower end of the carton body is closed by lower end closure flaps 20, 22, 24, and 26, which are foldably joined to the lower end edges of side wall panels 10, 12, 14, and 16 along fold lines 21, 23, 25, and 27, respectively. When the carton is closed the lower closure flaps may be folded inwardly and adhesively secured to each other in overlapped relationship.

The closure arrangement for the upper end of the carton is designed for dispensing of product material and reclosure. It includes first inner closure flap 30, outer closure flap 32, second inner closure flap 34, and intermediate closure flap 36, which are foldably joined to the upper end edges of side wall panels 10, 12, 14, and 16 along fold lines 31, 32, 33, and 34, respectively.

Inner closure flaps 30 and 34 are each preferably U-shaped and have adjacent inner edges that meet at the center of the carton. The inner closure flaps have opposed adjacent openings 45 and 47, which form a common opening when the carton is erected and the inner flaps are positioned in a common plane.

Figure 5:
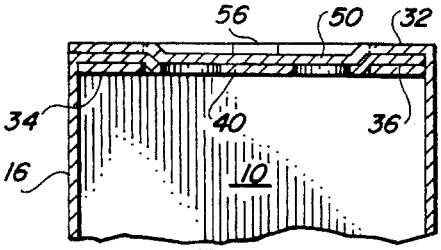
FIG. 5 is a partial sectional view taken on line 5—5 of FIG. 1, showing the carton top after initial opening and reclosure.

As best seen in FIGS. 2, 3, and 5, intermediate flap 36 has a central depressible portion 40 defined by a pair of cut lines 41 that extend through the intermediate flap. Portion 40 of intermediate flap 36 has one or more pouring holes 43 extending therethrough for dispensing product material from the carton.

The outer closure flap 32 includes a partially detachable pull-up portion 50 which is congruent with the intermediate flap depressible portion 40 and with the common opening formed by the openings 45 and 47 in the inner closure flaps.

Pull-up portion 50 is hingedly attached to the remaining portion of outer closure flap 32 and is defined by a rear hinge line 51, a pair of laterally spaced weakened lines of tear 53, and a free front edge. Hinge line 51 is interrupted by a relatively short, somewhat U-shaped, cut line 55 that defines a retaining tab 56 projecting rearwardly from the remainder of pull-up portion 50.

Pull-up portion may be provided with a crease or fold line 57, located slightly rearwardly from its front edge, which fold line forms a lift tab 58.

In order to fill and close the carton, after the carton has been erected to a tubular condition by the packer, the lower end may be closed and sealed in a conventional manner by folding the lower closure flaps inwardly and adhesively securing them to each other in overlapped condition.

The carton may then be filled by the packer, and the upper end may be closed. To close the carton, upper end inner closure flaps 30 and 34 are folded inwardly at right angles to the side wall panels, and intermediate closure flap 36 is folded over and adhesively secured to upper surfaces of the inner closure flaps.

Outer closure flap 32 is then folded inwardly and adhesively secured to the upper surface of intermediate closure flap 36. The adhesive patterns for the inner and intermediate closure flaps are shown at 60 and 62, respectively, in FIG. 3.

In order to open the carton and dispense material therefrom, the lift tab 58 is grasped and the pull-up portion 50 of outer closure flap 32 is pulled up to expose intermediate flap 36, which has pouring openings 43 extending therethrough.

As the pull-up portion 50 is pulled up, the small retaining tab 56 engages the upper surface of intermediate closure flap 36 to help keep pull-up portion 50 in the open position.

In order to reclose the carton, pull-up portion 50 is pushed downwardly into the plane of intermediate flap 36. This is made possible by the cut lines 41 in the intermediate flap that create the depressible portion 40 which can be forced downwardly into the common opening created by the adjacent openings 45 and 47 in the inner closure flaps, as best seen in FIG. 5.

Thus, when pull-up portion 50 is pushed down into the plane of intermediate flap 36, its side edges engage the edges of the intermediate flap, at the cut lines 41, to create a friction type of locking engagement between the outer and inner flaps.

This arrangement is particularly suitable for the packaging of granular materials, such as sugar, salt, bird seed, and similar products.

The design of the carton creates a special relationship between the intermediate and outer closure flaps that seals and locks the closure of the package far more securely and predictably that the closure arrangements of conventional shaker top dispensing cartons currently in common use.

What is claimed is:

1. A reclosable dispensing carton formed from a unitary blank of foldable paperboard, comprising:

(a) opposed pairs of first and second side wall panels foldably joined to each other to form a tubular body open at upper and lower ends thereof;

(b) bottom closure flaps foldably joined to lower edges of said side wall panels and secured to each other in overlapped relation to close the lower end of said body;

(c) a pair of inner closure flaps foldably joined to upper edges of respective of said first side wall panels, folded inwardly therefrom toward each other, and having adjacent openings that cooperate with each other to define a common inner closure flap opening;

(e) an intermediate closure flap, with at least one dispensing opening extending therethrough, foldably joined to an upper edge of one of said second side wall panels and being folded inwardly over and secured to upper surfaces of said inner closure flaps;

(f) an outer closure flap foldably joined to an upper edge of the other of said second side wall panels and folded inwardly over and secured to marginal areas of said intermediate closure flap;

(g) said outer closure flap including a partially detachable pull-up portion defined by a pair of weakened lines of tear connected by a hinge line hinging said pull-up portion to the remaining portion of said outer closure flap;

(h) said intermediate flap including a depressible portion that is substantially congruent to both the common inner closure flap opening and the outer closure flap pull-up portion, said depressible portion being defined by laterally spaced straight parallel cut lines that are aligned both with the inner edges of said inner closure flaps and with the outer closure flap weakened lines of tear, so that, after initial opening of the carton, said depressible portion can be partially depressed below the plane of said intermediate closure flap into the plane of the inner closure flaps and thereby accommodate the depression of said outer closure flap pull-up portion and its insertion, into the plane of said intermediate closure flap to effect a friction type locking reclosure.

2. A carton according to claim 1, wherein said intermediate closure flap depressible cut lines have major side portions, extending generally parallel to a fold line joining said intermediate closure flap to a related of said side wall panels, and minor end portions, extending toward each other and generally normal to said fold line.

3. A carton according to claim 1, wherein said outer closure flap weakened lines of tear have major side portions, extending generally parallel to a fold line joining said outer closure flap to a related of said side wall panels, and said pull-up portion hinge line extends generally normal to said fold line.

4. A reclosable dispensing carton formed from a unitary blank of foldable paperboard, comprising:

(a) opposed pairs of first and second side wall panels foldably joined to each other to form a tubular body open at upper and lower ends thereof;

(b) bottom closure flaps foldably joined to lower edges of said side wall panels and secured to each other in overlapped relation to close the lower end of said body;

(c) a pair of inner closure flaps foldably joined to upper edges of said first side wall panels, folded inwardly therefrom, and presenting a common inner closure flap opening;

(e) an intermediate closure flap, with at least one dispensing opening extending therethrough, foldably joined to an upper edge of one of said second side wall panels and being folded inwardly over and secured to upper surfaces of said inner closure flaps;

(f) an outer closure flap foldably joined to an upper edge of the other of said second side wall panels and folded inwardly over and secured to marginal areas of said intermediate closure flap;

(g) said outer closure flap including a partially detachable pull-up portion defined by a pair of weakened lines of tear connected by a hinge line hinging said pull-up portion to the remaining portion of said outer closure flap;

(h) said intermediate flap including a depressible portion that is substantially congruent to both the common inner closure flap opening and the outer closure flap pull-up portion, said depressible portion being defined by laterally spaced straight parallel cut lines that are aligned both with the inner edges of said inner closure flaps and with the outer closure flap weakened lines of tear, so that, after initial opening of the carton, said depressible portion can be partially depressed below the plane of said intermediate closure flap into the plane of the inner closure flaps and thereby accommodate the depression of said outer closure flap pull-up portion and its insertion, into the plane of said intermediate closure flap to effect a friction type locking reclosure.

5. A carton according to claim 4, wherein said intermediate closure flap depressible cut lines have major side portions, extending generally parallel to a fold line joining said intermediate closure flap to a related of said side wall panels, and minor end portions, extending toward each other and generally normal to said fold line.

6. A carton according to claim 4, wherein said outer closure flap weakened lines of tear have major side portions, extending generally parallel to a fold line joining said outer closure flap to a related of said side wall panels, and said pull-up portion hinge line extends generally normal to said fold line.

* * * * *